US011527371B2

(12) United States Patent
Izawa et al.

(10) Patent No.: US 11,527,371 B2
(45) Date of Patent: Dec. 13, 2022

(54) PUSH-BUTTON SWITCH WITH LUBRICANT RETAINING PORTION

(71) Applicant: OMRON Corporation, Kyoto (JP)

(72) Inventors: Kazuhira Izawa, Okayama (JP); Junichi Seto, Okayama (JP); Mamiko Naka, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/961,297

(22) PCT Filed: Jan. 17, 2019

(86) PCT No.: PCT/JP2019/001265
§ 371 (c)(1),
(2) Date: Jul. 10, 2020

(87) PCT Pub. No.: WO2019/159590
PCT Pub. Date: Aug. 22, 2019

(65) Prior Publication Data

US 2021/0082639 A1 Mar. 18, 2021

(30) Foreign Application Priority Data

Feb. 13, 2018 (JP) ..... JP2018-023425

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2013/525* (2013.01); *H01H 2221/024* (2013.01)

(58) Field of Classification Search
CPC .. H01H 13/14; H01H 13/52; H01H 2013/525; H01H 2221/024;
(Continued)

(56) References Cited

U.S. PATENT DOCUMENTS 6,420,670 B1 * 7/2002 Yu ..... H01H 13/568 200/341
6,455,795 B1 * 9/2002 Murakami ..... H01H 13/14 200/345
(Continued)

FOREIGN PATENT DOCUMENTS

CN 106298331 A 1/2017
CN 206639724 U 11/2017
(Continued)

OTHER PUBLICATIONS

English translation of the International Search Report ("ISR") of PCT/JP2019/001265 dated Apr. 23, 2019.
(Continued)

*Primary Examiner* — Lheiren Mae A Caroc
(74) *Attorney, Agent, or Firm* — Metrolex IP Law Group, PLLC

(57) ABSTRACT

A switch includes: a housing having a box shape; a plunger movable in a first direction intersecting an opening surface; and a movable piece arranged inside the housing and is elastically deformable in a second direction intersecting the first direction. The plunger has a touching portion which is arranged so as to face the movable piece in the second direction inside the housing and to be able to elastically deform the movable piece in the second direction by touching the movable piece, and further, a lubricant retaining portion that can retain a lubricant is provided in at least one of the touching portion of the plunger and a touched portion of the movable piece.

12 Claims, 11 Drawing Sheets

(58) Field of Classification Search
CPC .... H01H 13/7065; H01H 13/70; H01H 3/125; H01H 13/705; H01H 13/20; H01H 13/84; H01H 13/85; H01H 2221/026
See application file for complete search history.

(56) References Cited

U.S. PATENT DOCUMENTS

| | | | | |
|---|---|---|---|---|
| 8,766,122 | B2 * | 7/2014 | Takiguchi | H01H 3/62 200/341 |
| 9,305,721 | B2 * | 4/2016 | Izawa | H01H 13/20 |
| 2003/0079980 | A1 * | 5/2003 | Kiyono | H01H 21/282 200/520 |
| 2016/0071662 | A1 * | 3/2016 | Cai | H01H 13/14 200/314 |
| 2018/0323019 | A1 | 11/2018 | Wu | |

FOREIGN PATENT DOCUMENTS

| | | | |
|---|---|---|---|
| JP | S55-85732 | U | 6/1980 |
| JP | S61-138134 | U | 8/1986 |
| JP | 2002-231092 | A | 8/2002 |
| JP | 2008-198521 | A | 8/2008 |
| WO | 2017/121298 | A1 | 7/2017 |

OTHER PUBLICATIONS

Written Opinion("WO") of PCT/JP2019/001265 dated Apr. 23, 2019.
Office Action (CNOA) dated Dec. 3, 2021 in a counterpart Chinese patent application.
Office Action (CNOA) dated Jun. 10, 2022 in a counterpart Chinese patent application, with English translation.

* cited by examiner

PUSH-BUTTON SWITCH WITH LUBRICANT RETAINING PORTION

TECHNICAL FIELD

The disclosure relates to a push-button switch.

BACKGROUND ART

Patent Document 1 discloses a push-button switch. This switch includes a base, a key that can be moved up and down with respect to the base, and a fixed touch piece and a movable touch piece attached to the base. The fixed touch piece is provided with a fixed contact portion, and the movable touch piece is provided with a movable contact portion facing the fixed contact portion. Further, the movable touch piece is arranged so as to be movable by touching the key when the key is moved up and down with respect to the base, and is configured such that the movement of the movable touch piece causes the movable contact to touch or separate from the fixed contact.

PRIOR ART DOCUMENT

Patent Document

Patent Document 1: Chinese Utility Model No. 206639724

SUMMARY OF THE INVENTION

Problems to be Solved by the Invention

In the switch, a lubricant for suppressing abrasion may be applied to a touching location of the key and the movable touch piece to suppress abrasion. However, because the touching location of the key and the movable touch piece of the switch is usually flat and cannot retain the lubricant, the lubricant cannot be supplied to the touching location of the key and the movable touch piece for a long period of time, and there may be difficulty in extending the life of the switch.

It is an object of the disclosure to provide a switch that can achieve a long life.

Means for Solving the Problem

A switch as an example of the disclosure includes: a housing having a box shape and an opening surface; a plunger configured to move along a first direction intersecting the opening surface; and a movable piece arranged inside the housing and configured to elastically deform in a second direction intersecting the first direction. The plunger includes a touching portion arranged so as to face the movable piece in the second direction inside the housing and configured to elastically deform the movable piece in the second direction by touching the movable piece, the plunger being arranged to be movable between a first position in which the touching portion touches the movable piece along the first direction to elastically deform the movable piece in the second direction, and a second position different from the first position. Further, a lubricant retaining portion configured to retain a lubricant is provided in at least one of the touching portion of the plunger and a touched portion of the movable piece touched by the touching portion.

Effect of the Invention

According to the switch, the lubricant retaining portion that can hold the lubricant is provided in at least one of the touching portion of the plunger and the touched portion of the movable piece. By the lubricant retaining portion, the lubricant can be supplied to the touching portion of the plunger and the touched portion of the movable piece for a long period of time, therefore, the life of the switch can be extended.

MODE FOR CARRYING OUT THE INVENTION

Hereinafter, an example of the disclosure is described with reference to the accompanying drawings. In the following description, terms indicating specific directions or positions (for example, terms including "up", "down", "right", and "left") are used as necessary. However, these terms is used only for facilitating the understanding of the disclosure with reference to the drawings, and the technical scope of the disclosure is not limited by the meaning of these terms. Further, the following description is merely illustrative in nature and is not intended to limit the disclosure, the application thereof, or the use thereof. Furthermore, the drawings are schematic, and the ratios of dimensions and the like do not necessarily match the actual dimensions.

Figure 1:
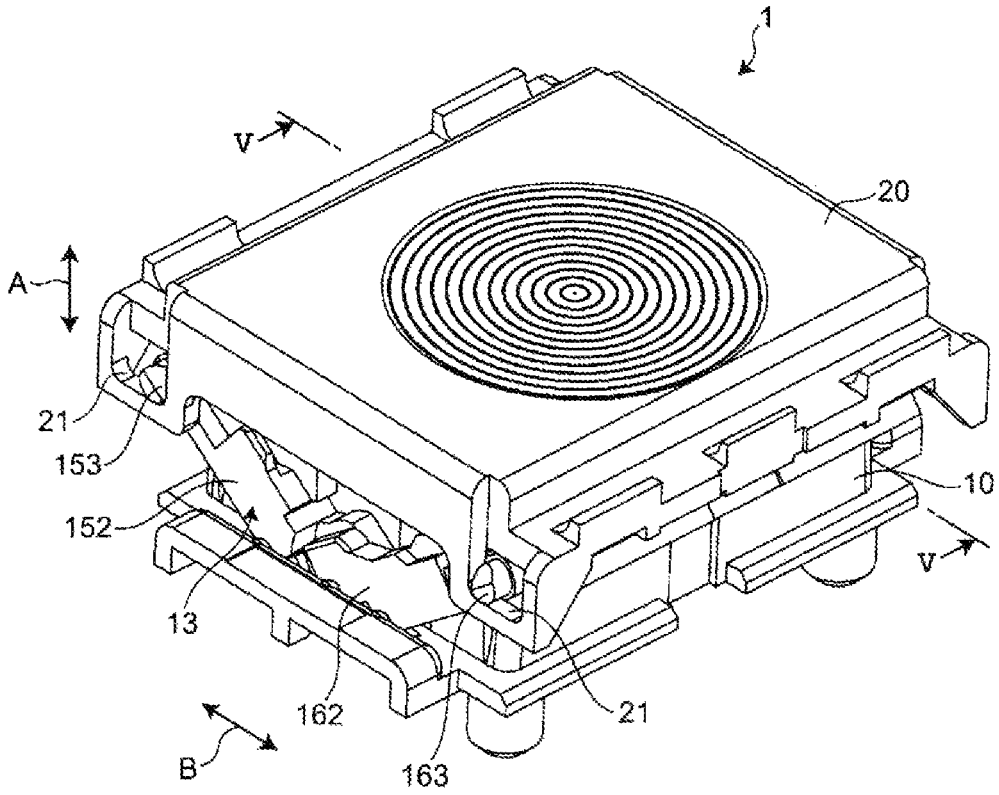
FIG. 1 is a perspective view showing a switch according to one embodiment of the disclosure.
Figure 2:
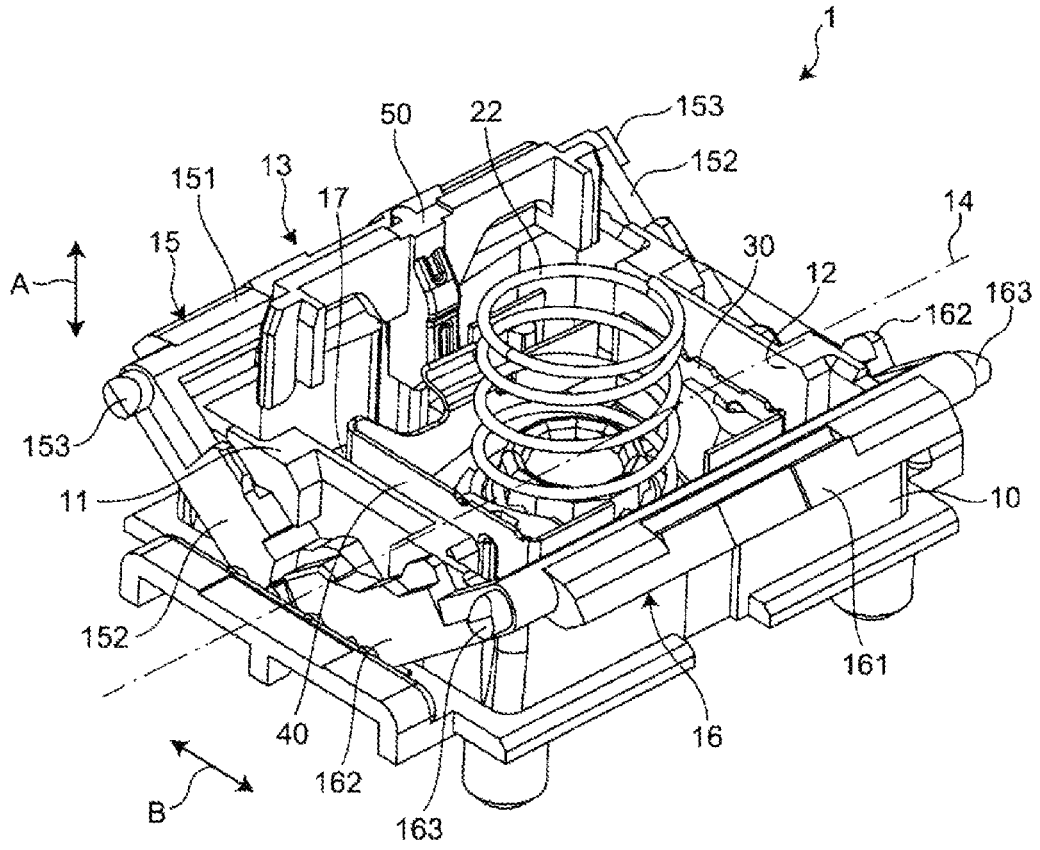
FIG. 2 is a perspective view showing a state in which a button of the switch in FIG. 1 is removed.

As shown in FIG. 1, a switch 1 according to one embodiment of the disclosure includes a housing 10 and a button 20 attached to the housing 10. Further, as shown in FIG. 2, a fixed piece 30, a movable piece 40, and a plunger 50 are provided inside the housing 10. As an example, the housing 10, the button 20, and the plunger 50 are each made of insulating resin, and the fixed piece 30 and the movable piece 40 are each made of conductive metal.

As shown in FIG. 2, the housing 10 has a substantially rectangular box shape and has an opening surface 11 in which an opening 12 is provided. A lifting mechanism 13 is provided on the outer periphery of the housing 10. When viewed from a direction orthogonal to the opening surface 11, the lifting mechanism 13 has two arms 15, 16 rotatably attached to the housing 10 about a rotation axis 14 passing through the center in a short-side direction of the housing 10 and extending in a long-side direction of the housing 10.

When viewed from the direction orthogonal to the opening surface 11, the arms 15, 16 are constituted of shafts 151, 161 extending in the long-side direction of the housing 10, supports 152, 162 extending in a direction orthogonal to the extending direction of the shafts 151, 161 from both end portions in the extending direction of the shafts 151, 161, and latching projections 153, 163 extending along the extending direction of the shafts 151, 161 from the both end portions in the extending direction of the shafts 151, 161. A leading end portion of each of the supports 152, 162 (that is, end portions farther from the shafts 151, 161) is rotatably attached to the housing 10.

As shown in FIG. 1, the button 20 has a substantially rectangular parallelepiped shape, and is connected to the lifting mechanism 13 while interposing latching receivers 21 (only two are shown in FIG. 1) that latch the latching projections 153, 163 of the lifting mechanism 13 which are provided at respective corner portions. That is, the button 20 is attached to the housing 10 while interposing the lifting mechanism 13 so as to be movable along a first direction A intersecting the opening surface 11 (that is, the vertical direction in FIG. 1).

Further, as shown in FIG. 2, the button 20 is biased in the first direction A and also in a direction from a bottom portion 17 toward the opening surface 11 of the housing 10 by a coil spring 22 provided inside the housing 10 and at a substantially central portion of the bottom portion 17 facing the opening surface 11 in the first direction A of the housing 10.

Figure 3:
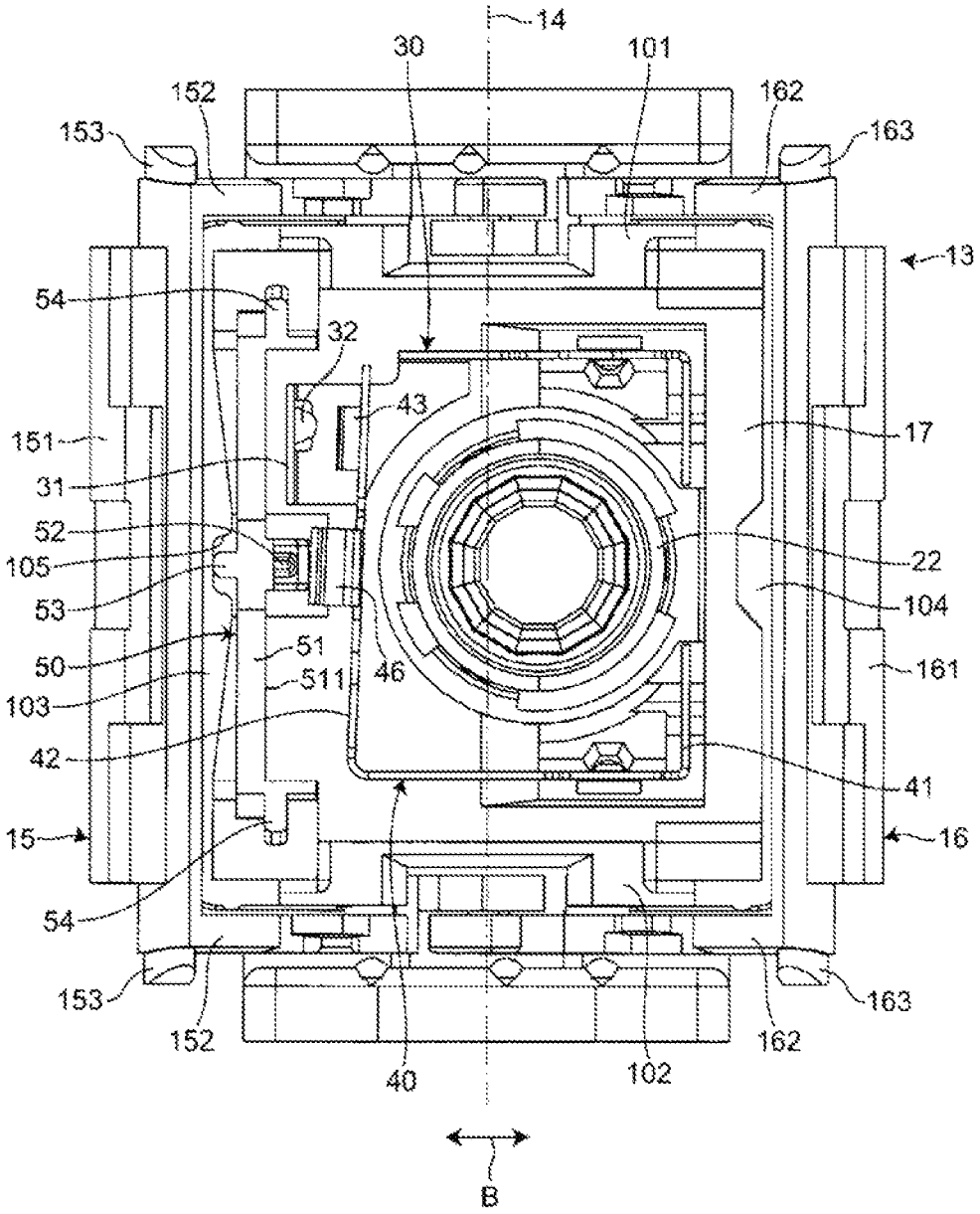
FIG. 3 is a plan view showing the state in which the button of the switch in FIG. 1 is removed.

As shown in FIG. 3, the fixed piece 30 is fixed to the bottom portion 17 of the housing 10 inside the housing 10. Specifically, when viewed from the first direction A (that is, from a penetrating direction of FIG. 3), the fixed piece 30 is arranged between a first wall 101 being one of a pair of walls 101, 102 extending in the short-side direction of the housing 10 and the coil spring 22. When viewed from the first direction A, the fixed piece 30 has a contact arrangement portion 31 arranged on one side (that is, the left side in FIG. 3) of the rotation axis 14 of the lifting mechanism 13 in the short-side direction of the housing 10 (that is, a second direction B intersecting the first direction A).

The contact arrangement portion 31 has a plate shape that extends along a third wall 103 being the closer one of a pair of walls 103, 104 extending in the long-side direction of the housing 10, and a fixed contact portion 32 is provided on a plate surface facing the fourth wall 104 being the farther one of the pair of walls 103, 104.

As shown in FIG. 3, the movable piece 40 is arranged so as to be electrically independent of the fixed piece 30. Specifically, when viewed from the first direction A, the movable piece 40 is arranged between the coil spring 22 and the second wall 102 being the other of the pair of walls 101, 102 extending in the short-side direction of the housing 10. The movable piece 40 has a fixed portion 41 fixed inside the housing 10, and a movable portion 42 connected to the fixed portion 41 and elastically deformable in the second direction B.

As shown in FIG. 3, the fixed portion 41 is arranged on the side of the fourth wall 104 of the housing 10 in the second direction B, with respect to the rotation axis 14 of the lifting mechanism 13. The movable portion 42 has a plate shape extending from the fixed portion 41 along the third wall 103 of the housing 10 when viewed from the first direction A, and is arranged such that a leading end portion thereof is arranged between the contact arrangement portion 31 of the fixed piece 30 and the coil spring 22, and each of the plate surfaces is oriented in the second direction B to face the third wall 103 and the fourth wall 104 of the housing 10. A movable contact portion 43 is provided at the leading end portion of the movable portion 42 so as to face the fixed contact portion 32 in the second direction B.

Figure 5:
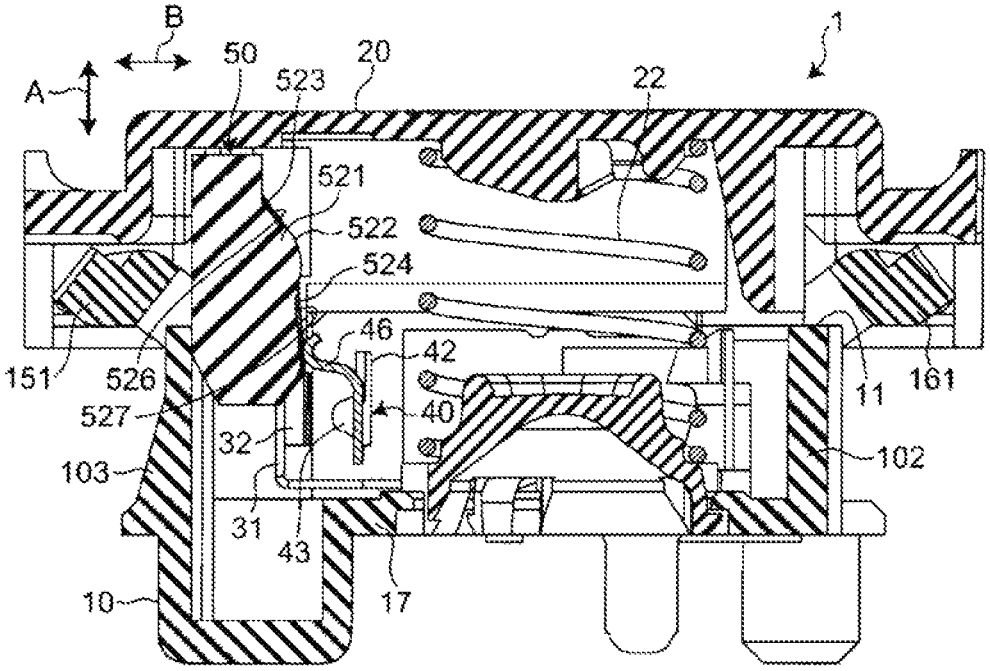
FIG. 5 is a cross-sectional view taken along a line V-V of FIG. 1 of the switch of FIG. 1 in a returned state.

In addition, when viewed from the first direction A, the movable portion 42 is provided with a touched portion 46 touched by a touching portion 52 of a plunger 50 described later, at an intermediate portion in the long-side direction of the housing 10. As shown in FIG. 5, the touched portion 46 extends from the movable portion 42 in the second direction B and toward the third wall 103 of the housing 10, and has the leading end portion thereof bent and curved in the second direction B and toward the fourth wall 104 of the housing 10.

The movable portion 42 is arranged such that the movable contact portion 43 touches the fixed contact portion 32 at an initial position where no external force is applied. When the touching portion 52 of the plunger 50 described later touches the touched portion 46, the movable portion 42 elastically deforms in the second direction B and toward the fourth wall 104 (that is, a direction in which the movable contact portion 43 moves away from the fixed contact portion 32).

As shown in FIG. 3, the plunger 50 is arranged while being connected to the button 20 between the third wall 103 of the housing 10 and the contact arrangement portion 31 of the fixed piece 30 when viewed from the first direction A, and is configured to be movable along the first direction A by moving of the button 20 along the first direction A.

Figure 4:
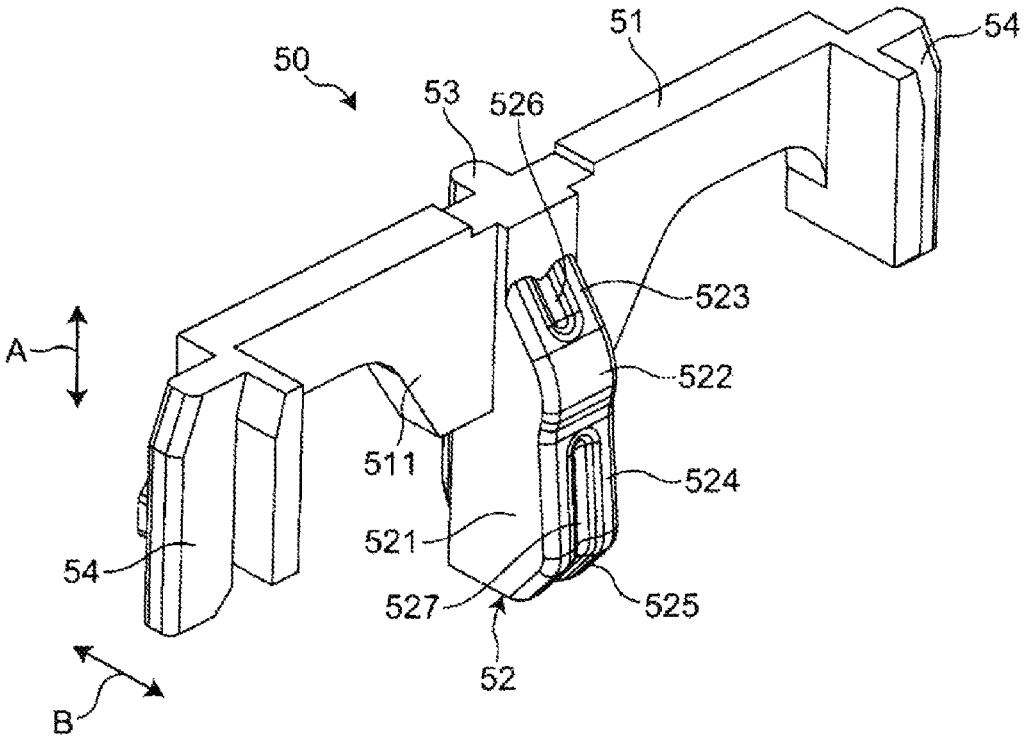
FIG. 4 is a perspective view showing a plunger of the switch shown in FIG. 1.

Specifically, as shown in FIG. 4, when viewed from the first direction A, the plunger 50 includes a main body 51 having a plate shape and extending along the long-side direction of the housing 10, and the touching portion 52 provided at an intermediate portion in the extending direction of the main body 51, projected from the main body 51 toward the movable portion 42 of the movable piece 40, and extending in the first direction A.

Further, at the intermediate portion in the extending direction of the main body 51, a guide rail 53 is provided, which projects from the main body 51 toward the third wall 103 of the housing 10 and extends from the main body 51 in the first direction A. As shown in FIG. 3, when viewed from the first direction A, the guide rail 53 is arranged in a guide groove portion 105 provided in a substantially central portion of the third wall 103 of the housing 10 in the long-side direction of the housing 10 and extending in the first direction A, and is configured to facilitate movement of the plunger 50 in the first direction A.

Connecting portions 54 each having a rail shape and extending in the first direction A are provided at both end portions in the extending direction of the main body 51. The plunger 50 and the button 20 are connected while interposing the connecting portions 54.

As shown in FIG. 4, the touching portion 52 is arranged so as to face the movable portion 42 of the movable piece 40 inside the housing 10 in the second direction B and be able to touch the movable portion 42 to elastically deform the movable portion 42 in the second direction B.

Specifically, the touching portion 52 includes a projection 521 extending in the first direction A and protruding in the second direction B and in a direction toward the movable portion 42 of the movable piece 40, and a projecting portion 522 provided at an intermediate portion in the first direction A of the projection 521.

As shown in FIG. 4, the projection 521 has a first inclined surface 523, a second inclined surface 524, and a third inclined surface 525, and is configured to touch the touched portion 46 of the movable piece 40 between a first position in which the plunger 50 is separated farther from the bottom portion 17 of the housing 10 than from the opening surface 11 (see FIG. 5), and a second position in which the plunger 50 is closer to the bottom portion 17 facing the opening surface 11 of the housing 10 than in the first position.

The first inclined surface 523 is provided on one side of the projecting portion 522 in the first direction A (that is, on the side closer to the button 20 than the projecting portion 522 and on the upper side in FIG. 4), and as separating from the button along the first direction A (that is, from the upper side to the lower side in FIG. 4), the first inclined surface 523 is inclined in the second direction B and in a direction approaching the movable portion 42 of the movable piece 40.

The second inclined surface 524 is provided on the other side of the projecting portion 522 in the first direction A (that is, on the side closer to the bottom portion 17 of the housing 10 than the projecting portion 522 and on the lower side in FIG. 4). Similarly to the first inclined surface 523, the second inclined surface 524 is inclined in the second direction B and in the direction approaching the movable portion 42 of the movable piece 40 as separating from the button along the first direction A. The second inclined surface 524 is formed such that an inclination angle with respect to a side surface 511 of the main body 51 in the second direction B is smaller than an inclination angle of the first inclined surface 523.

The third inclined surface 525 is connected to an end portion of the second inclined surface 524 farther from the button 20 in the first direction A (that is, the lower end portion in FIG. 4), and is inclined in the second direction B and a direction separating from the movable portion 42 of the movable piece 40 as separating from the button 20 along the first direction A.

As shown in FIG. 4, the projecting portion 522 is arranged between the first inclined surface 523 and the second inclined surface 524, and has a curved projecting shape that approaches the movable portion 42 of the movable piece 40 in the second direction B. The projecting portion 522 is configured to press and touch the touched portion 46 of the movable piece 40 between the first position (see FIG. 5) and the second position (see FIG. 6).

Further, as shown in FIG. 4, the touching portion 52 is provided with a first groove portion 526 arranged on the surface of one side of the projecting portion 522 in the first direction A (that is, the side of the first inclined surface 523 of the projecting portion 522), and a second groove portion 527 arranged on the surface of the other side of the projecting portion 522 in the first direction A (that is, on the side of the second inclined surface 524 of the projecting portion 522). The first groove portion 526 extends from the projecting portion 522 along the first direction A on the first inclined surface 523 toward the button 20 (that is, upward in FIG. 4). Further, the second groove portion 527 extends from the projecting portion 522 along the first direction A on the second inclined surface 524 and on the third inclined surface 525 toward the bottom portion 17 of the housing 10 (that is, downward in FIG. 4). Each of the first groove portion 526 and the second groove portion 527 has a substantially U-shaped cross-sectional shape, and is independently arranged at an interval in the first direction A.

The first groove portion 526 and the second groove portion 527 are examples of the first retaining portion and the second retaining portion, respectively, and configure a lubricant retaining portion that can retain a lubricant. As the lubricant, for example, a liquid lubricant such as oil, a semi-solid lubricant such as olefinic grease, and a solid lubricant such as graphite can be used.

Next, an operation of the switch is described with reference to FIGS. 5 and 6.

As shown in FIG. 5, in the switch 1 in a state of no external force being applied to the button 20, the button 20 is biased by the coil spring 22 in the first direction A and in the direction from the bottom portion 17 of the housing 10 toward the opening surface 11 (that is, upward in FIG. 5), and is arranged farther from the bottom portion 17 of the housing 10 than the opening surface 11 of the housing 10 in the first direction A.

In the state shown in FIG. 5, in the plunger 50, the projecting portion 522 of the touching portion 52 is located outside the housing 10 (that is, the first position). In this first position, the second inclined surface 524 of the touching portion 52 touches the touched portion 46 of the movable piece 40, to cause the movable portion 42 to elastically deform in the second direction B and the movable contact portion 43 to elastically deform in a direction separating from the fixed contact portion 32 (that is, rightward in FIG. 5). That is, in the plunger 50, in the first position, the touching portion 52 touches the movable portion 42 of the movable piece 40 to elastically deform the movable portion 42 in the second direction B. As a result, the movable contact portion 43 is separated from the fixed contact portion 32, and the switch 1 is in a returned state.

Figure 6:
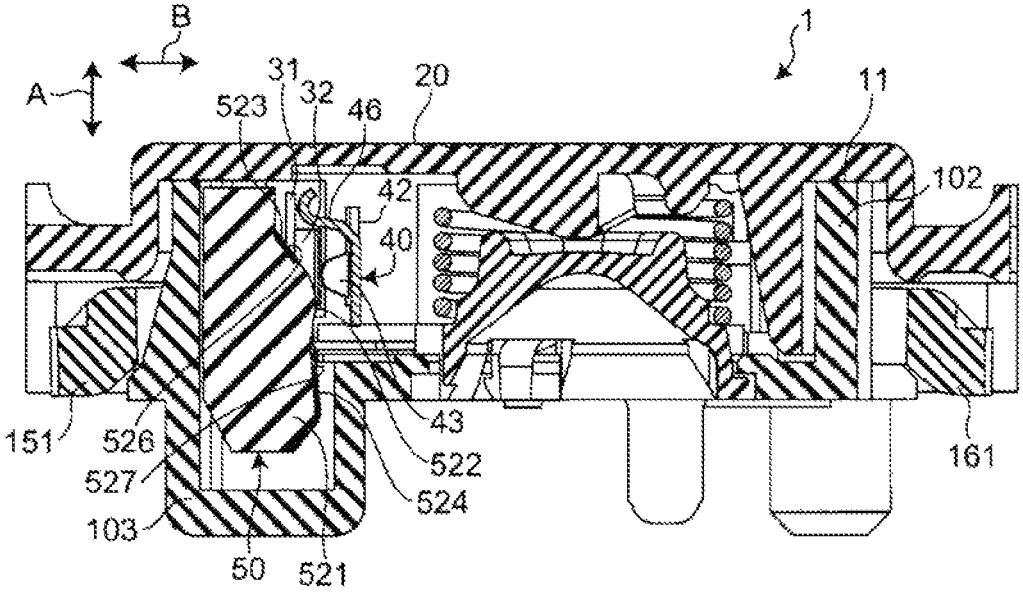
FIG. 6 is a cross-sectional view taken along the line V-V of FIG. 1 of the switch of FIG. 1 in an operating state.

When an external force is applied to the button 20 to move the button 20 against the biasing force of the coil spring 22 in the first direction A toward the bottom portion 17 of the housing 10, as shown in FIG. 6, the button 20 touches the opening surface 11 of the housing 10 and stops.

At this time, with the movement of the button 20 along the first direction A, the plunger 50 also moves toward the bottom portion 17 of the housing 10 along the first direction A, and the projecting portion 522 of the touching portion 52 stops in a state of located inside the housing 10 (that is, a second position different from the first position). In the second position, the touching portion 52 does not touch the touched portion 46 of the movable piece 40, and the movable portion 42 being elastically deformed is returned to the initial position. As a result, the movable contact portion 43 comes into contact with the fixed contact portion 32 to bring the switch 1 into an operating state.

When the external force applied to the button 20 is released, the button 20 moves in the direction separating from the bottom portion 17 of the housing 10 along the first direction A by the biasing force of the coil spring 22. With this movement of the button 20, the plunger 50 also moves from the second position to the first position.

Thus, when the switch 1 shifts from the returned state to the operating state, the touching portion 52 moves (that is, slides) while touching the touched portion 46 of the movable piece 40 in the order of the second inclined surface 524, the projecting portion 522, and the first inclined surface 523.

Further, when the switch 1 shifts from the operating state to the returned state, the touching portion 52 moves while touching the touched portion 46 of the movable piece 40 in the order of the first inclined surface 523, the projecting portion 522, and the second inclined surface 524. At this time, the lubricant retained in the first groove portion 526 and the second groove portion 527 is supplied to the touching portion 52 of the plunger 50 and the touched portion 46 of the movable piece 40, and abrasion of the touching portion 52 of the plunger 50 and touched portion 46 of the movable piece 40 is suppressed. In other words, in the switch 1, the first groove portion 526 and the second groove portion 527 can supply the lubricant to the touching portion 52 of the plunger 50 and the touched portion 46 of the movable piece 40 for a long period of time, therefore, the life of the switch 1 can be extended.

Note that an operation feeling (that is, a click feeling) is generated by a change in moving load of the plunger 50 from the time when the projecting portion 522 of the touching portion 52 presses and touches the touched portion 46 of the movable piece 40 until the time when the touched portion 46 gets over the projecting portion 522, and by a collision sound generated by the connecting portion 54 colliding the button 20 when the touched portion 46 gets over the projecting portion 522 and the plunger 50 independently moves in the first direction A toward the direction approaching the bottom portion 17 of the housing 10. With this operation feeling, for example, the fact is notified that the touching state of the fixed contact portion 32 and the movable contact portion 43 has been switched (that is, the state of the movable contact portion 43 with respect to the fixed contact portion 32 is switched from the separated state to the touching state, or, the state of the movable contact portion 43 with respect to the fixed contact portion 32 is switched from the touching state to the separated state).

That is, because the projecting portion 522 of the touching portion 52 presses and touches the touched portion 46 of the movable piece 40, the projecting portion 522 is easily worn away due to abrasion. Therefore, by arranging the first groove portion 526 and the second groove portion 527 independently in the first direction A at the interval without providing the lubricant retaining portion in the projecting portion 522, the switch 1 that can more reliably achieve a long life while maintaining the operation feeling can be realized.

Shapes and sizes of the touching portion 52 of the plunger 50 and the touched portion 46 of the movable piece 40 can be appropriately changed according to a design of the switch 1 and the like.

For example, the plunger 50 may be connected to the button 20 or may not be connected to the button 20. The plunger 50 is not limited to being provided separately from the button 20, but may be provided integrally with the button 20.

The touching portion 52 only needs to touch the movable portion 42 of the movable piece 40 to elastically deform the movable portion 42 in the second direction B, and the first inclined surface 523 and the second inclined surface 524 of the touching portion 52 may have a curved surface or have a flat surface with respect to the side surface of the main body 51. Further, the third inclined surface 525 can be omitted.

The lubricant retaining portion may be provided in at least a part of a region where the touched portion 46 of the movable piece 40 is touched. For example, only one of the first groove portion 526 and the second groove portion 527 may be provided as the lubricant retaining portion, or only the second groove portion 527 may be provided on the second inclined surface 524.

Further, for example, as shown in FIGS. 7 to 12, in addition to the first groove portion 526 and the second groove portion 527, the lubricant retaining portion may have a third groove portion 528 provided on the projecting portion 522 and is connected to the first groove portion 526 and the second groove portion 527. As described above, by the lubricant retaining portion having the first to third groove portions 526, 527, 528, the lubricant is supplied to the touching portion 52 of the plunger 50 and the touched portion 46 of the movable piece 40 for a longer period of time. Therefore, the life of the switch 1 can be extended more reliably.

Figure 7:
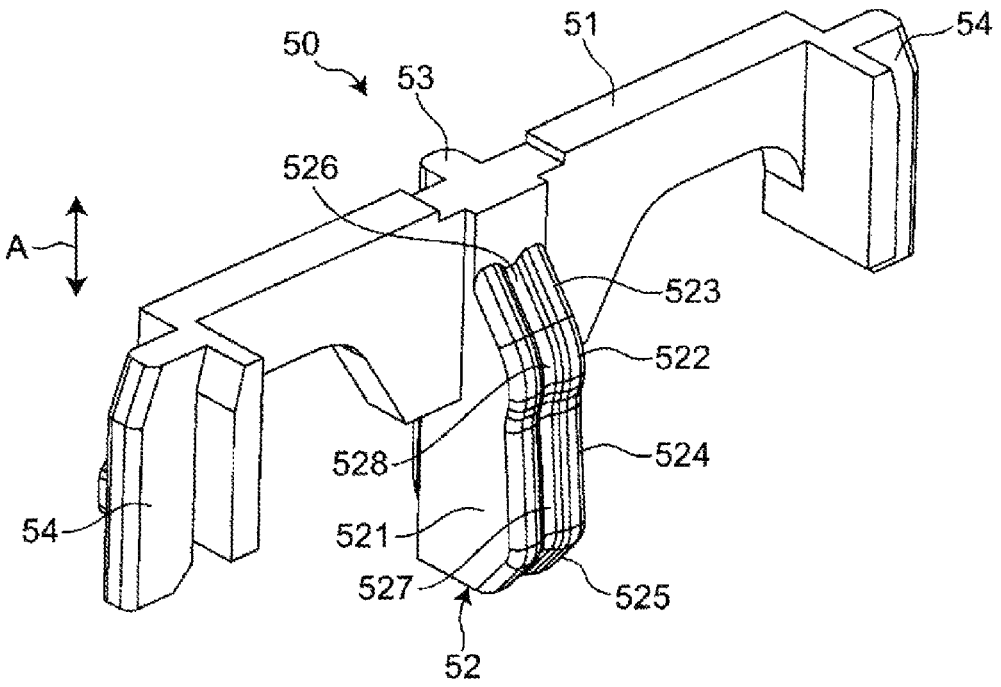
FIG. 7 is a perspective view of a plunger showing a first modified example of the switch of FIG. 1.
Figure 8:
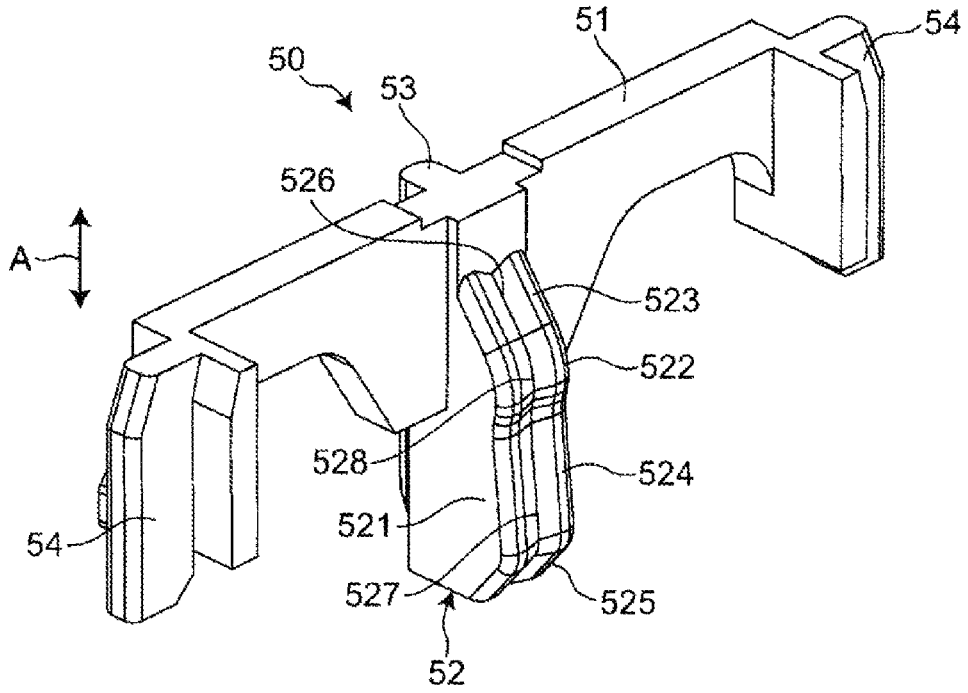
FIG. 8 is a perspective view of a plunger showing a second modified example of the switch of FIG. 1.
Figure 9:
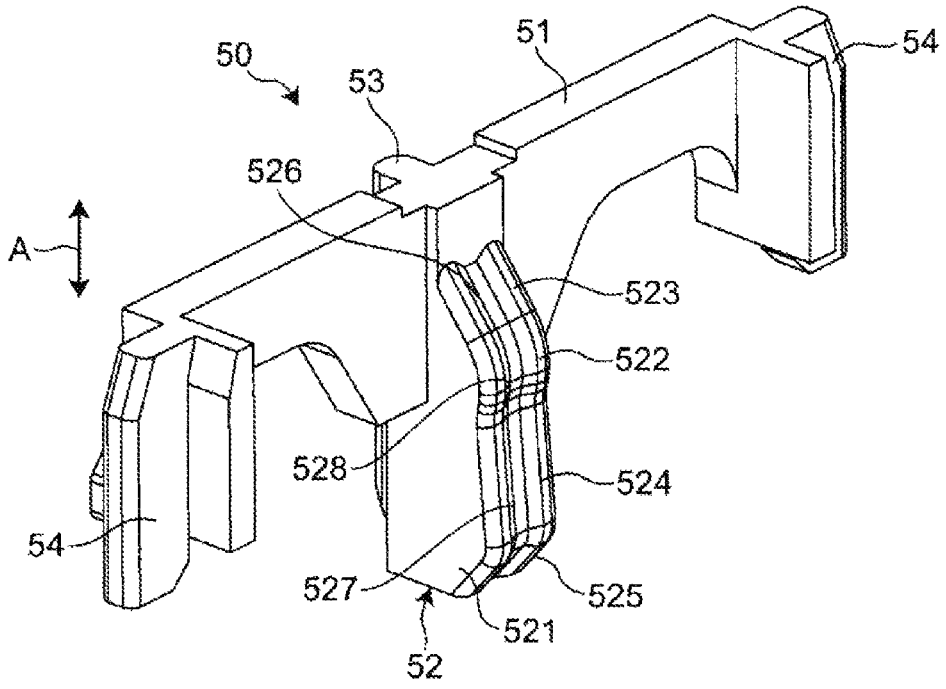
FIG. 9 is a perspective view of a plunger showing a third modified example of the switch of FIG. 1.
Figure 10:
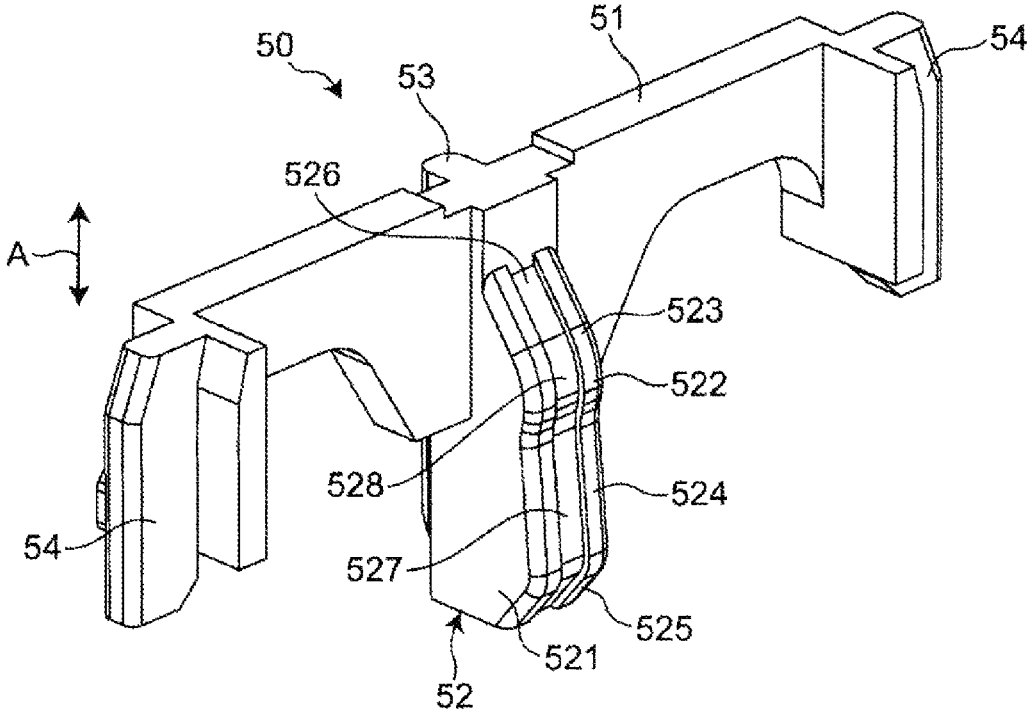
FIG. 10 is a perspective view of a plunger showing a fourth modified example of the switch of FIG. 1.

Each of the groove portions 526, 527, 528 can adopt an arbitrary cross-sectional shape. For example, a cross section of each of the groove portions 526, 527, 528 may be substantially U-shaped as shown in FIG. 7, may be substantially V-shaped as shown in FIG. 8, may be substantially trapezoidal shaped as shown in FIG. 9, or may be substantially square shaped as shown in FIG. 10. For example, by making the cross sections of the groove portions 526, 527, 528 substantially U-shaped, the lubricant retained in the groove portions 526, 527, 528 can be easily supplied to the touching portion 52 of the plunger 50 and the touched portion 46 of the movable piece 40, and accordingly, the life of the switch 1 can be extended more reliably. Additionally, the lubricant retained in each of the groove portions 526, 527, 528 becomes easy to be supplied to the touching portion 52 of the plunger 50 and the touched portion 46 of the movable piece 40 by chamfering an opening edge of each of the groove portions 526, 527, 528.

Figure 11:
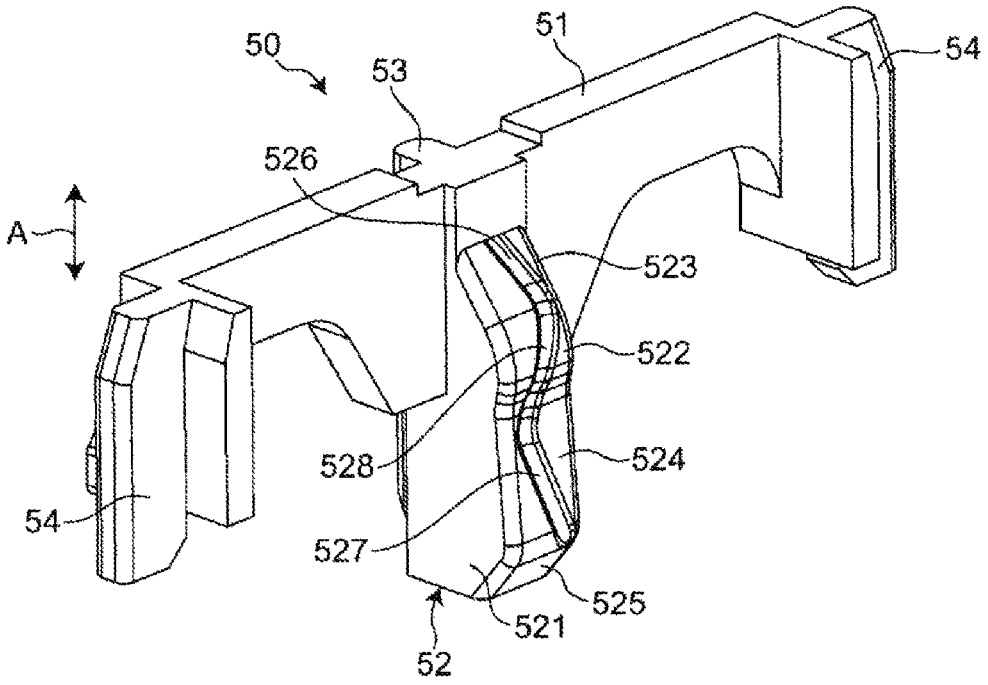
FIG. 11 is a perspective view of a plunger showing a fifth modified example of the switch of FIG. 1.

Further, each of the groove portions 526, 527, 528 may only need to extend along the first direction A. For example, each of the groove portions 526, 527, 528 may be arranged in a straight line extending substantially parallel to the first direction A as shown in FIGS. 7 to 10, or may be arranged in a meandering shape that intersects the first direction A alternately in different directions, as shown in FIG. 11. By arranging the groove portions 526, 527, and 528 in the meandering shape, the lubricant can be supplied over a wide range of the touching portion 52 of the plunger 50 and the touched portion 46 of the movable piece 40.

Figure 12:
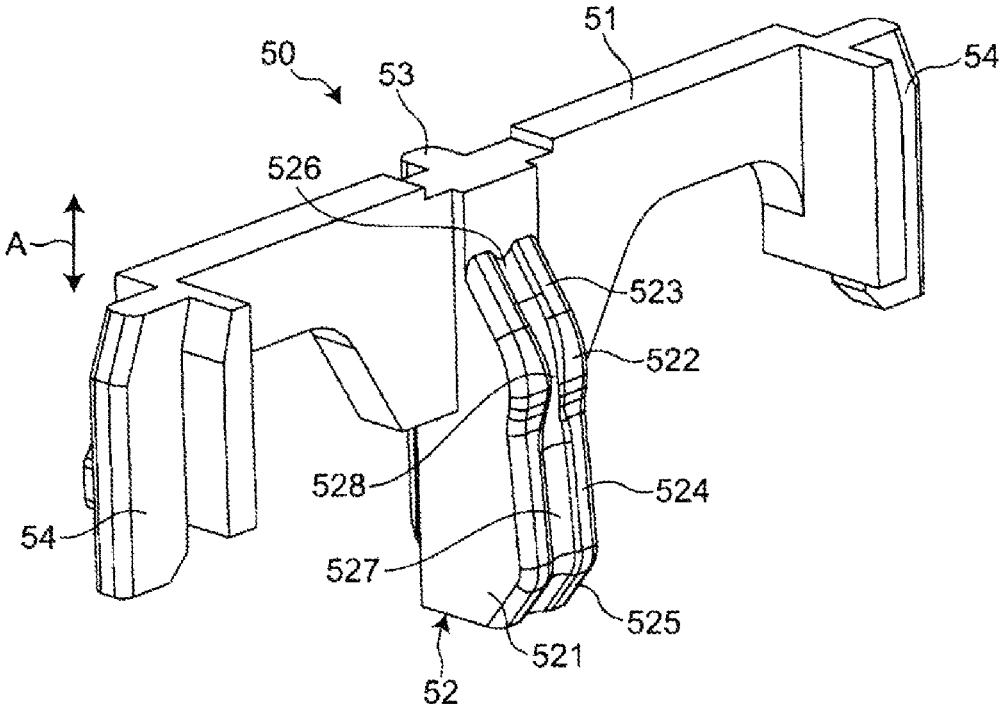
FIG. 12 is a perspective view of a plunger showing a sixth modified example of the switch of FIG. 1.

A groove width and a groove depth of each of the groove portions 526, 527, 528 can be appropriately changed according to the design of the switch 1 and the like. For example, as shown in FIG. 12, the groove width of the third groove portion 528 may be configured to be smaller than the groove width of the first groove portion 526 and the groove width of the second groove portion 527. As described above, by making the groove width of the third groove portion 528 smaller than the groove width of the first groove portion 526 and the groove width of the second groove portion 527, a touching area to the touched portion 46 by the projecting portion 522 that is easily worn away by abrasion can be made large as compared to the plunger 50 of FIGS. 7 to 11, and therefore, the switch 1 that can achieve a long life while maintaining the operation feeling can be realized. Further, for example, by making the groove depth of each of the groove portions 526, 527, 528 shallower as the groove approaches both end portions in the extending direction, the lubricant retained in each of the groove portions 526, 527, 528 can be easily supplied to the touching portion 52 of the plunger 50 and the touched portion 46 of the movable piece 40, and therefore, the life of the switch 1 can be extended more reliably.

Figure 13:
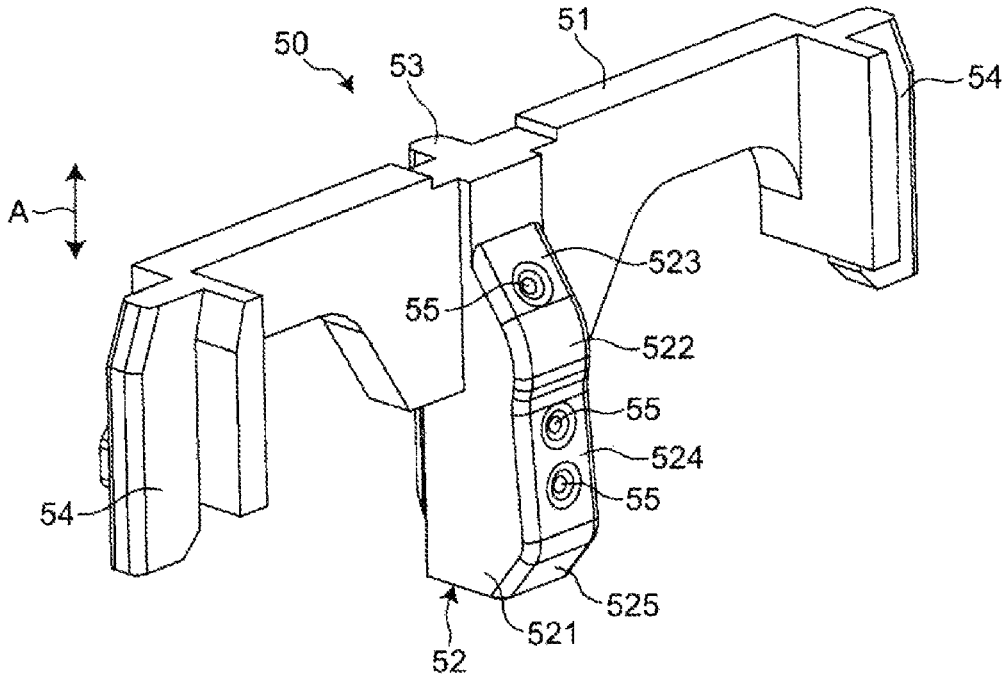
FIG. 13 is a perspective view of a plunger showing a seventh modified example of the switch of FIG. 1.

Further, the lubricant retaining portion is not limited to the case of being constituted of each of the groove portions 526, 527, 528, but for example, as shown in FIG. 13, may be constituted of a plurality of recessed portions 55 (three recessed portions 55 in FIG. 13) which are independently arranged along the first direction A. Each of the recessed portions 55 is not limited to having a substantially circular opening shown in FIG. 13, but may have an opening having other shapes (for example, a square shape, a trapezoidal shape, and a triangular shape).

Figure 14:
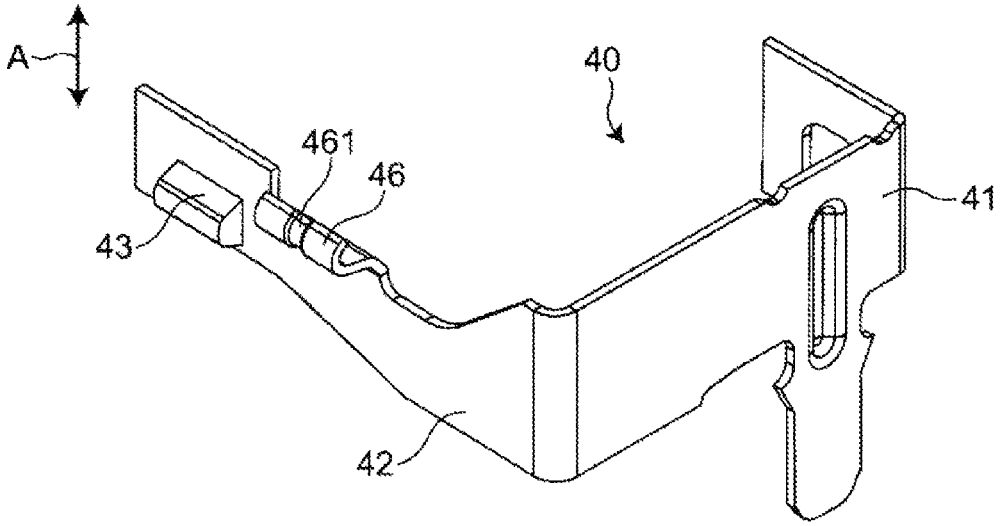
FIG. 14 is a perspective view of a movable piece showing an eighth modified example of the switch of FIG. 1.

Further, the lubricant retaining portion is not limited to being provided in the touching portion 52 of the plunger 50, but may be provided in the touched portion 46 of the movable piece 40. In this case, for example, without providing the first groove portion 526 and the second groove portion 527 in the touching portion 52 of the plunger 50, as shown in FIG. 14, the touched portion 46 of the movable piece 40 may be provided with a fourth groove portion 461 extending in the first direction A as an example of the lubricant retaining portion. Further, if possible, the configuration of the touching portion 52 of the plunger 50 and the configuration of the touched portion 46 of the movable piece 40 may be directly exchanged. That is, the plunger 50 may be provided with a touching portion having the same configuration as the touched portion 46, and the movable piece 40 may be provided with a touched portion having the same configuration as the touching portion 52.

The lubricant retaining portion may be provided on at least one of the touching portion 52 of the plunger 50 and the touched portion 46 of the movable piece 40. For example, the touching portion 52 of the plunger 50 may have the first groove portion 526 and the second groove portion 527, and the touched portion 46 of the movable piece 40 may be provided with the fourth groove portion 461.

The disclosure is applicable not only to the switch 1 but, for example, also to a switch 100 shown in FIGS. 15 to 18, which includes a fixed piece 30, a movable piece 40, and a plunger 50. In this switch 100, the plunger 50 has a fourth inclined surface 152 inclined in the second direction B and a direction approaching a movable portion 42 of the movable piece 40 as extending from the upper side to the lower side in FIGS. 15 and 17 along the first direction A, and the movable piece 40 has a protrusion 146 that can touch the fourth inclined surface 152. The fourth inclined surface 152 is provided with a fifth groove portion 56 extending along the first direction A and being an example of the lubricant retaining portion.

Figure 15:
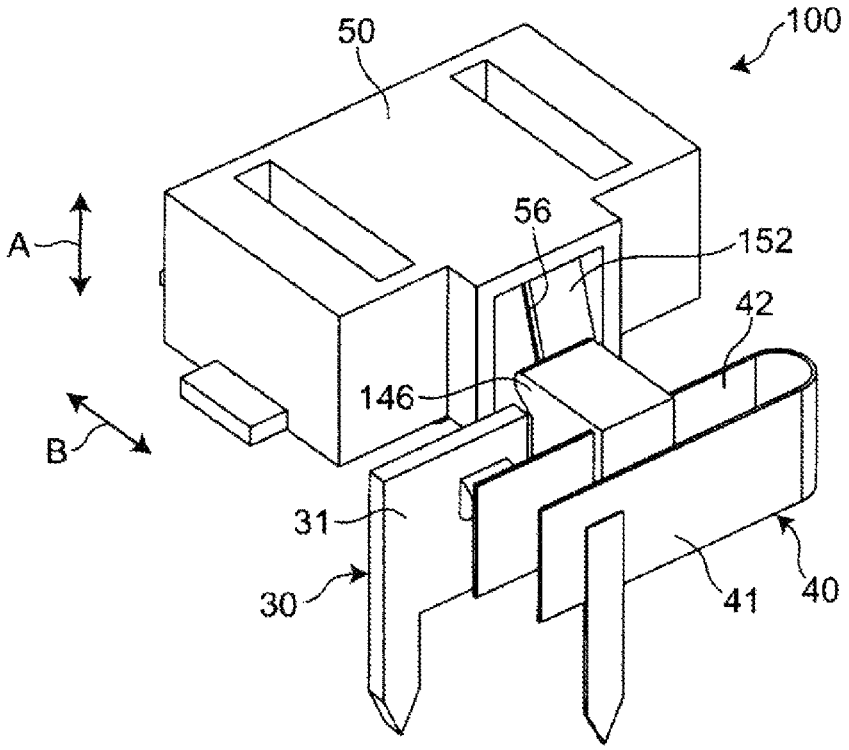
FIG. 15 is a perspective view showing a ninth modified example of the switch of FIG. 1 in a returned state of a fixed piece, a movable piece, and a plunger.
Figure 16:
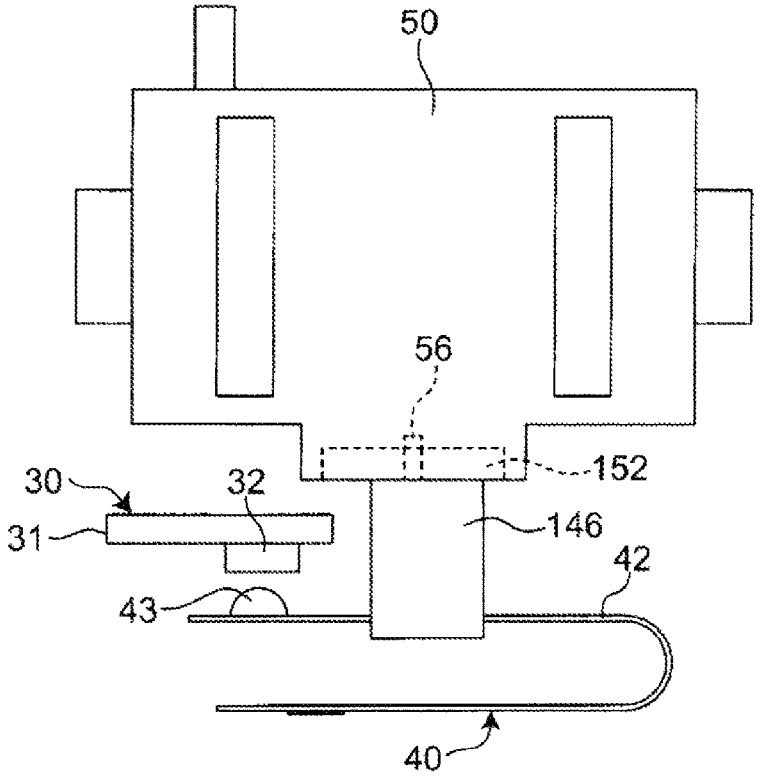
FIG. 16 is a plan view showing the ninth modified example of the switch of FIG. 1 in the returned state of the fixed piece, the movable piece, and the plunger.
Figure 17:
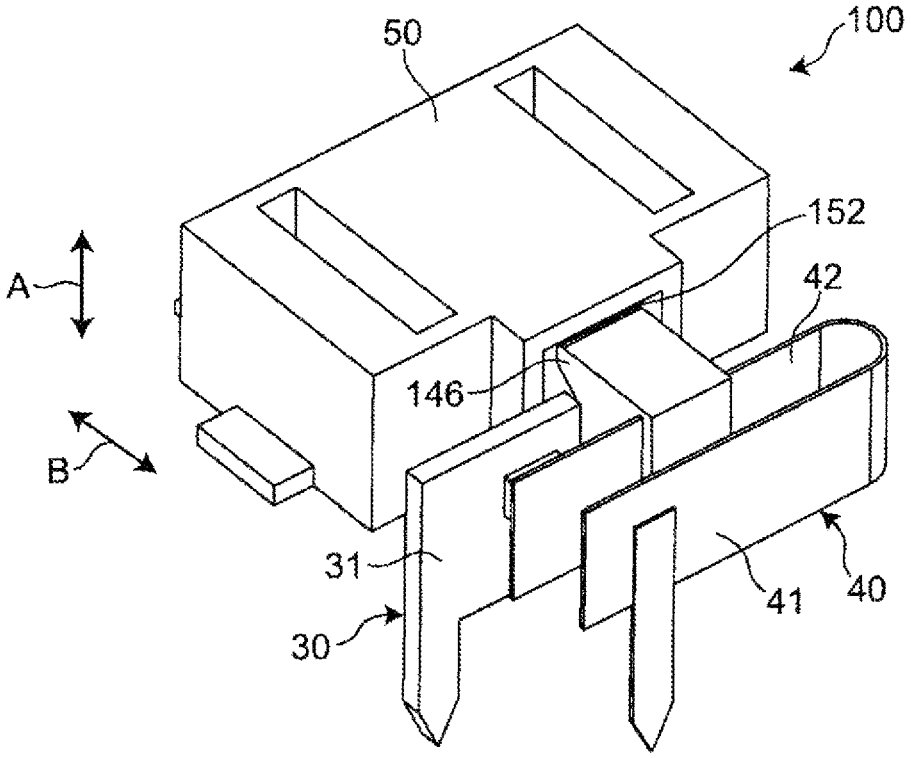
FIG. 17 is a perspective view showing the ninth modified example of the switch of FIG. 1 in an operating state of the fixed piece, the movable piece, and the plunger.
Figure 18:
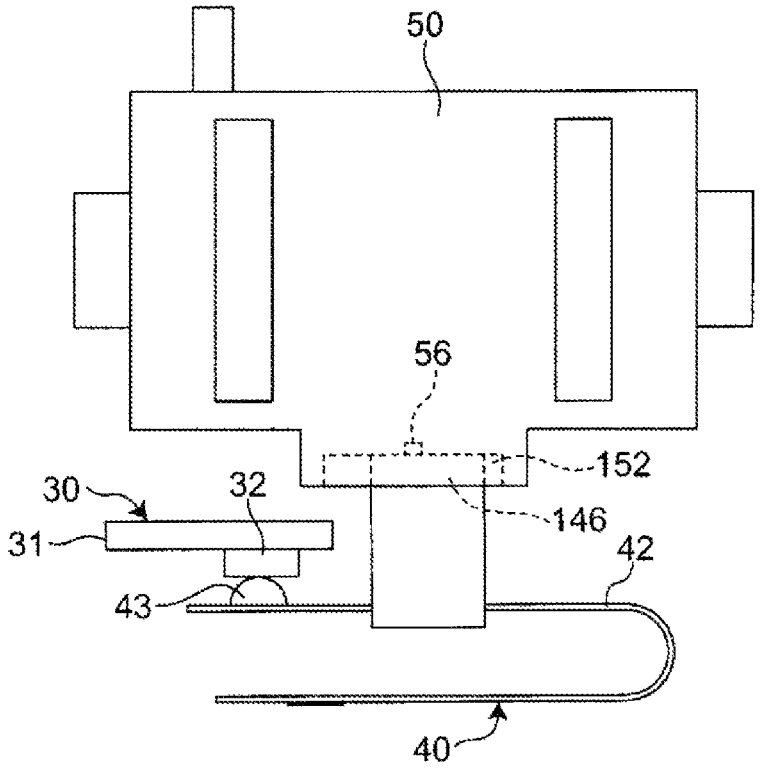
FIG. 18 is a plan view showing the ninth modified example of the switch of FIG. 1 in an operating state of the fixed piece, the movable piece, and the plunger.

As shown in FIGS. 15 and 16, in a state of the protrusion 146 touching the lower end portion of the fourth inclined surface 152, a movable contact portion 43 separates from a fixed contact portion 32, and the switch 100 is returned to the returned state. Further, as shown in FIGS. 17 and 18, in a state of the protrusion 146 touching the upper end portion of the fourth inclined surface 152, the movable contact portion 43 touches the fixed contact portion 32 and the switch 100 is turned to the operating state. That is, the switch 100 is configured such that, as the plunger 50 moves along the first direction A and the touching position of the protrusion 146 of the movable piece 40 to the fourth inclined surface 152 of the plunger 50 moves from the upper end to the lower end on the fifth groove portion 56, the fourth inclined surface 152 causes the movable portion 42 to elastically deform, via the protrusion 146, in the second direction and in the direction in which the movable contact portion 43 separates from the fixed contact portion 32.

Further, the disclosure is applicable not only to the switch 1 in which the touching portion 52 of the plunger 50 elastically deforms the movable portion 42 of the movable piece 40 in the returned state and the movable portion 42 of the movable piece 40 returns to the initial position in the operating state, but also applicable to a switch configured such that the touching portion of the plunger elastically deforms the movable portion of the movable piece in the operating state, and the movable portion of the movable piece returns to the initial position in the returned state.

Further, the disclosure is applicable not only to the switch 1 in which the fixed contact portion 32 is directly provided on the fixed piece 30 and the movable contact portion 43 is directly provided on the movable piece 40, but also applicable to a switch in which the fixed contact portion is not directly provided on the fixed piece and the movable contact portion is not directly provided on the movable piece.

As described above, the disclosure is not limited to the switch 1, but may be a switch including a housing having a box shape and an opening surface, a plunger movable along a first direction intersecting the opening surface, and a movable piece arranged inside the housing and being elastically deformable in a second direction intersecting the first direction. In the switch, the plunger may have a touching portion arranged so as to face the movable piece in the second direction inside the housing and to be able to elastically deform the movable piece in the second direction by touching the movable piece, the plunger being arranged to be movable between a first position in which the touching portion touches the movable piece along the first direction to elastically deform the movable piece in the second direction, and a second position which is different from the first position. And further, in the switch, a lubricant retaining portion that can retain a lubricant may be provided in at least one of the touching portion of the plunger and a touched portion of the movable piece touched by the touching portion. That is, the disclosure can be applied to switches of various aspects, and thus a switch with a high degree of freedom in design and a long life can be realized.

Although various embodiments in the disclosure have been described in detail above with reference to the drawings, finally, various aspects of the disclosure are described. In the following description, the reference symbols are also given as an example.

A switch 1 of a first aspect of the disclosure includes: a housing 10 having a box shape and an opening surface 11; a plunger 50 movable along a first direction A intersecting the opening surface 11; and a movable piece 40 arranged inside the housing 10 and being elastically deformable in a second direction B intersecting the first direction A. Further, the plunger 50 has a touching portion 52 arranged so as to face the movable piece 40 in the second direction B inside the housing 10 and to be able to elastically deform the movable piece 40 in the second direction B by touching the movable piece 40, the plunger 50 being arranged to be movable between a first position in which the touching portion 52 touches the movable piece 40 along the first direction A to elastically deform the movable piece 40 in the second direction B, and a second position different from the first position. Still further, lubricant retaining portions 526, 527, 528, 461, 55, 56 that can retain a lubricant are provided in at least one of the touching portion 52 of the plunger 50 and a touched portion 46 of the movable piece 40 touched by the touching portion 52.

According to the switch 1 of the first aspect, the lubricant retaining portions 526, 527, 528, 461, 55, 56 that can retain the lubricant are provided on at least one of the touching portion 52 of the plunger 50 and the touched portion 46 of the movable piece 40 touched by the touching portion 52. By the lubricant retaining portions 526, 527, 528, 461, 55, 56, the lubricant can be supplied to the touching portion 52 of the plunger 50 and the touched portion 46 of the movable piece 40 for a long period of time, and accordingly, the life of the switch 1 can be extended.

The switch 1 of a second aspect of the disclosure further includes a fixed piece 30 fixed inside the housing 10 and having a fixed contact portion 32. Further, the movable piece 40 includes: a fixed portion 41 fixed inside the housing 10; and a movable portion 42 provided with a movable contact portion 43 facing the fixed contact portion 32 in the second direction B and provided with the touched portion 46, and also connected to the fixed portion 41 and being elastically deformable in the second direction B. Still further, the movable piece 40 is arranged electrically independent of the fixed piece 30, and by the movable portion 42 elastically deforming in the second direction B, causes the movable contact portion 43 to touch or separate from the fixed contact portion 32.

According to the switch 1 of the second aspect, at least one of the touching portion 52 of the plunger 50 and the touched portion 46 touched by the touching portion 52 in the movable portion 42 of the movable piece 40 is provided with the lubricant retaining portions 526, 527, 528, 461, 55, 56 that can retain the lubricant. By the lubricant retaining portions 526, 527, 528, 461, 55, 56, the lubricant can be supplied to the touching portion 52 of the plunger 50 and the touched portion 46 of the movable piece 40 for a long period of time, and accordingly, the life of the switch 1 can be extended.

In the switch 1 of a third aspect of the disclosure, the touching portion 52 includes: a projection 521 extending along the first direction A and having a projecting shape that protrudes in the second direction B and in a direction approaching the movable portion 42, and touching the touched portion 46 between the first position and the second position; and a projecting portion 522 provided at an intermediate portion of the projection 521 in the first direction A so as to protrude from the projection 521 in the second direction B and in the direction approaching the movable portion 42, and with which the plunger 50 presses and touches the touched portion 46 between the first position and the second position. Further, the lubricant retaining portion includes at least one of a first retaining portion 526 arranged on a surface of one side in the first direction A of the projecting portion 522 of the projection 521, and a second retaining portion 527 arranged on a surface of the other side in the first direction A of the projecting portion 522 of the projection 521.

According to the switch of the third aspect, the lubricant can be supplied to the touching portion 52 of the plunger 50 and the touched portion 46 of the movable piece 40 by the lubricant retaining portions 526, 527 for a long period of time, and accordingly, the life of the switch 1 can be extended.

In the switch 1 of a fourth aspect of the disclosure, the lubricant retaining portion includes the first retaining portion 526 and the second retaining portion 527, and the first retaining portion 526 and the second retaining portion 527 are arranged independently at an interval in the first direction A.

According to the switch 1 of the fourth aspect, the first groove portion 526 and the second groove portion 527 are independently arranged in the first direction A at the interval without providing the lubricant retaining portion on the projecting portion 522 that presses and touches the touched portion 46 to generate an operation feeling. Accordingly, the switch 1 that can more reliably achieve a long life while maintaining the operation feeling can be realized.

In the switch 1 of a fifth aspect of the disclosure, the lubricant retaining portion includes the first retaining portion 526 and the second retaining portion 527, and a third retaining portion 528 provided on the projecting portion 522 and connected to the first retaining portion 526 and the second retaining portion 527.

According to the switch 1 of the fifth aspect, the lubricant can be supplied to the touching portion 52 of the plunger 50 and the touched portion 46 of the movable piece 40 for a longer period of time, and accordingly, the life of the switch 1 can be extended more reliably.

In the switch 1 of a sixth aspect of the disclosure, the first retaining portion, the second retaining portion, and the third retaining portion are constituted of a first groove portion 526, a second groove portion 527, and a third groove portion 528, respectively, the first groove portion, the second groove portion, and the third groove portion extending along the first direction A, and a groove width of the third groove portion 528 is configured to be smaller than a groove width of the first groove portion 526 and a groove width of the second groove portion 527.

According to the switch 1 of the sixth aspect, the touching area to the touched portion 46 by the projecting portion 522 that presses and touches the touched portion 46 to generate the operation feeling. and accordingly, the switch 1 that can reliably achieve a long life can be realized.

In the switch 1 of a seventh aspect of the disclosure, the lubricant retaining portion is constituted of groove portions 526, 527, 528, 461, 56 extending along the first direction A.

According to the switch 1 of the seventh aspect, the switch 1 with a high degree of freedom in design and a long life can be realized.

In the switch 1 of an eighth aspect of the disclosure, the lubricant retaining portion is constituted of a plurality of recessed portions 55 independently arranged along the first direction A.

According to the switch of the eighth aspect, a switch with a high degree of freedom in design and a long life can be realized.

In the switch 1 of a ninth aspect of the disclosure, the lubricant retaining portions 526, 527, 528, 55, 56 are provided on the touching portion 52 of the plunger 50.

According to the switch 1 of the ninth aspect, the switch 1 with a high degree of freedom in design and a long life can be realized.

In the switch 1 of a tenth aspect of the disclosure, the lubricant retaining portion 461 is provided on the touched portion 46 of the movable portion 42.

According to the switch 1 of the tenth aspect, the switch 1 with a high degree of freedom in design and a long life can be realized.

In addition, by appropriately combining any of the embodiments or modified examples among the various embodiments or modified examples, effects of each thereof can be exhibited. Further, combinations of the embodiments, combinations of the examples, or combinations of the embodiments and examples are possible, and combinations of features in different embodiments or examples are also possible.

While the disclosure has been fully described in connection with the preferred embodiments with reference to the accompanying drawings, various variations and modifications will be apparent to those skilled in the art. Unless such changes and modifications otherwise depart from the scope of the disclosure as set forth in the appended claims, they should be construed as being included therein.

INDUSTRIAL APPLICABILITY

The switch of the disclosure can be applied to, for example, a keyboard switch.

DESCRIPTION OF SYMBOLS

1 switch
10 housing
101 first wall
102 second wall
103 third wall
104 fourth wall
105 guide groove portion
11 opening surface
12 opening
13 lifting mechanism
14 rotation axis
15, 16 arm
17 bottom portion
151, 161 shaft
152, 162 support
153, 163 latching projection
20 button
21 latching receiver
22 coil spring
30 fixed piece
31 contact arrangement portion
32 fixed contact portion
40 movable piece
41 fixed portion
42 movable portion
43 movable contact portion
46 touched portion
461 fourth groove portion
50 plunger
51 main body
521 projection
522 projecting portion
523 first inclined surface
524 second inclined surface
525 third inclined surface
526 first groove portion
527 second groove portion
528 third groove portion
52 touching portion
53 guide rail
54 connecting portion
55 recessed portion
56 fifth groove portion
146 protrusion
152 fourth inclined surface
A first direction
B second direction

The invention claimed is:

1. A switch comprising:

a housing comprising a box shape and an opening surface;

a plunger configured to move along a first direction intersecting the opening surface; and a movable piece arranged inside the housing and configured to elastically deform in a second direction intersecting the first direction, wherein the plunger comprises a touching portion arranged so as to face the movable piece in the second direction inside the housing and configured to elastically deform the movable piece in the second direction by touching the movable piece at a touched portion thereof, the plunger being arranged to be movable between a first position, in which the touching portion touches the movable piece to elastically deform the movable piece in the second direction, and a second position different from the first position, the touching portion comprising:

a projection extending in the first direction and comprising a projecting shape that protrudes in the second direction and in a direction approaching the movable piece, and configured to touch the touched portion when the plunger is located between the first position and the second position; and a projecting portion, provided at an intermediate portion of the projection, protruding from the projection in the second direction and in the direction approaching the movable piece, and with which the plunger presses and touches the touched portion when the plunger is located between the first position and the second position, and the touching portion further comprises a lubricant retaining portion specifically formed to retain a lubricant provided in at least one of the touching portion of the plunger and the touched portion of the movable piece touched by the touching portion, the lubricant retaining portion comprising at least one of a first retaining portion arranged, in the first direction, on a surface of the projecting portion, and a second retaining portion arranged, in the first direction, on a surface of another side of the projection.

2. The switch according to claim 1 further comprising:

a fixed piece fixed inside the housing and comprising a fixed contact portion, wherein the movable piece comprises:

a fixed portion fixed inside the housing; and a movable portion provided with a movable contact portion facing the fixed contact portion in the second direction and provided with the touched portion, and also connected to the fixed portion and configured to elastically deform in the second direction, wherein the movable piece is arranged to be electrically independent of the fixed piece, and is configured to, by the movable portion elastically deforming in the second direction, cause the movable contact portion to touch or separate from the fixed contact portion.

3. The switch according to claim 2, wherein the lubricant retaining portion comprises a groove portion extending along the first direction.

4. The switch according to claim 2, wherein the lubricant retaining portion comprises a plurality of recessed portions independently arranged along the first direction.

5. The switch according to claim 2, wherein the lubricant retaining portion is provided on the touching portion of the plunger.

6. The switch according to claim 2, further comprising a second lubricant retaining portion provided on the touched portion of the movable piece.

7. The switch according to claim 1, wherein the lubricant retaining portion comprises the first retaining portion and the second retaining portion, and the first retaining portion and the second retaining portion are arranged independently at an interval in the first direction.

8. The switch according to claim 1, wherein the lubricant retaining portion comprises the first retaining portion, the second retaining portion, and a third retaining portion provided on the projecting portion and connected to the first retaining portion and the second retaining portion.

9. The switch according to claim 8, wherein the first retaining portion, the second retaining portion, and the third retaining portion comprise a first groove portion, a second groove portion, and a third groove portion, respectively, the first groove portion, the second groove portion and the third groove portion extending along the first direction, and wherein a groove width of the third groove portion is configured to be smaller than a groove width of the first groove portion and a groove width of the second groove portion.

10. The switch according to claim 1, wherein the lubricant retaining portion comprises a groove portion extending along the first direction.

11. The switch according to claim 1, wherein the lubricant retaining portion comprises a plurality of recessed portions independently arranged along the first direction.

12. The switch according to claim 1, further comprising a second lubricant retaining portion provided on the touched portion of the movable piece.

* * * * *